United States Patent [19]

Johansson et al.

[11] Patent Number: 4,501,198

[45] Date of Patent: Feb. 26, 1985

[54] DEVICE FOR COMPRESSING IN PARTICULAR ALUMINUM CANS

[75] Inventors: Sune H. Johansson; John K. C. Gustavsson, both of Sävsjö , Sweden

[73] Assignee: Magnus Wilhelm AB, Sävsjö , Sweden

[21] Appl. No.: 475,866

[22] Filed: Mar. 16, 1983

[30] Foreign Application Priority Data

Mar. 25, 1982 [SE] Sweden ..... 8201897

[51] Int. Cl.[3] ..... B30B 9/32

[52] U.S. Cl. ..... 100/98 R; 100/151; 100/902

[58] Field of Search ..... 100/902, 98 R, 151, 100/152, 153, 154, 156, 210; 241/99, 200

[56] References Cited

U.S. PATENT DOCUMENTS

| | | | |
|---|---|---|---|
| 1,140,676 | 5/1915 | Gray | 100/902 |
| 2,343,916 | 3/1944 | Long | 100/151 |
| 3,077,827 | 2/1963 | Bunke | 100/902 |
| 3,680,476 | 8/1972 | Pfeiffer | 100/151 |
| 3,691,942 | 9/1972 | Wagley | 100/902 X |
| 4,018,394 | 4/1977 | Sorbier | 241/200 |
| 4,261,259 | 4/1981 | Beardslee | 100/152 |

*Primary Examiner*—Billy J. Wilhite
*Attorney, Agent, or Firm*—Staas & Halsey

[57] ABSTRACT

A compression device particularly for aluminum cans comprises a frame and an endless driven belt mounted therein and provided with friction means on its outer side. A hold-down member in the form of a plate of a low-friction elastic plastic material is so disposed along and opposite one run of the belt that this run and the hold-down member at one end (inlet end) of the belt will be spaced from each other a distance which exceeds the maximum diameter of the can to be subjected to compression, and progressively approach one another such that they will be located close to each other at the opposite end (discharge end) of the belt. The hold-down member is fixedly anchored to the frame at the inlet end of the belt and bears on rubber springs at the discharge end of the belt, whereby a can received at the inlet end of the belt is progressively compressible in an advantageous way, such that a completely flattened can body will leave at the discharge end of the belt, with one can end pressed against one flat side of the can and the other can end pressed against the opposite flat side of the can.

10 Claims, 5 Drawing Figures

FIG. 1
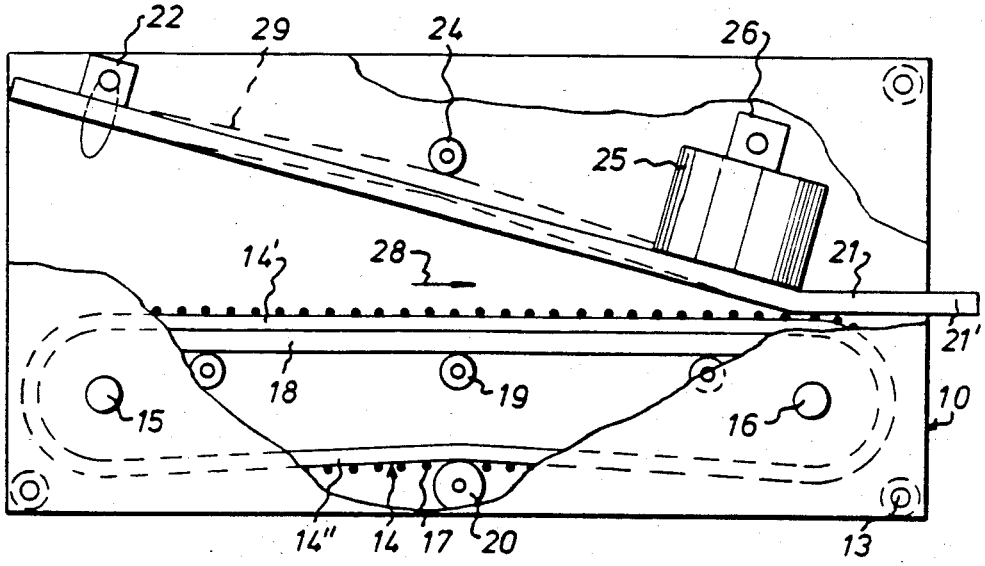
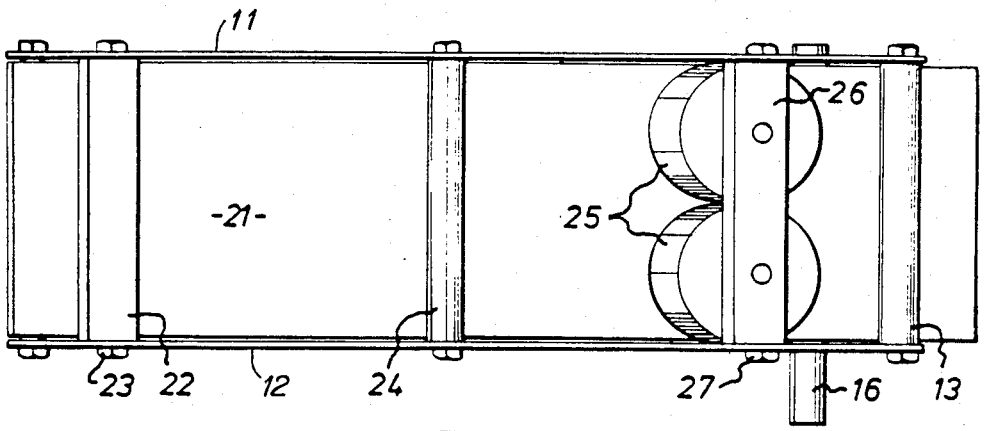
FIG. 2

FIG. 4
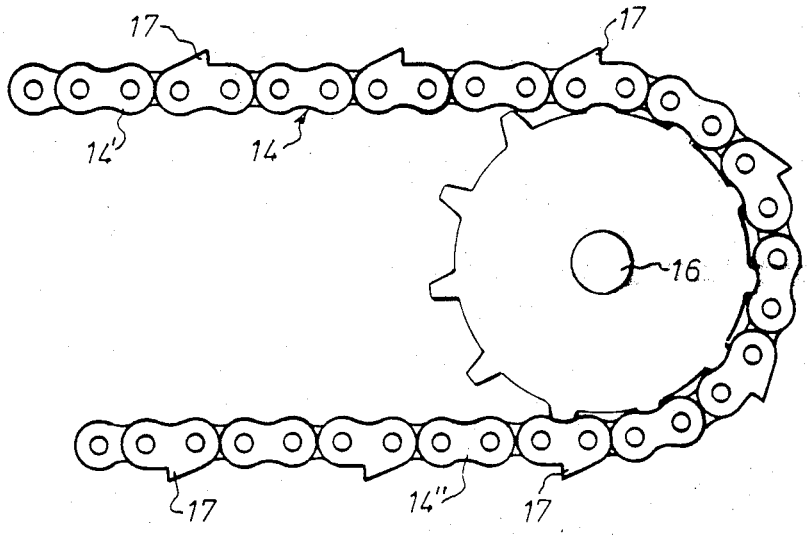
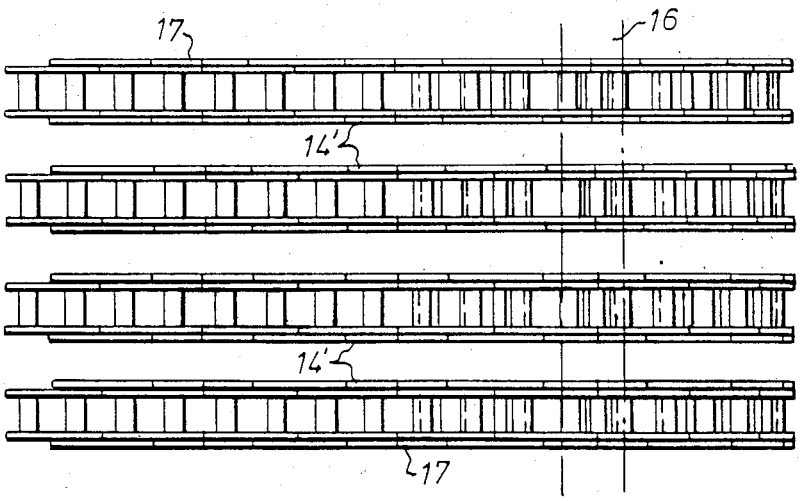
FIG. 5

DEVICE FOR COMPRESSING IN PARTICULAR ALUMINUM CANS

BACKGROUND OF THE INVENTION

The present invention relates to a device for compressing in particular aluminum cans, comprising a frame, an endless driven belt in the frame, and a hold-down member extending along and located opposite one run of the belt, said belt run and said hold-down member being spaced from each other at one end (inlet end) of the belt a distance which exceeds the maximum diameter of the can to be subjected to compression, and progressively approaching each other to a position in which they are located close to each other at the opposite end (discharge end) of the belt, and the hold-down member being resiliently yieldable in a direction away from the belt, at least throughout its proximal portion with respect to the discharge end of the belt.

In the compression of water and refuse, use is normally made of apparatuses operating with piston and cylinder assemblies, but also apparatuses with endless belts which progressively approach each other and thus will compress waste placed therebetween. Both types of apparatuses are intended for managing waste of the most varying kinds and although cans can be compressed therein, the compression is not effected under optimum conditions. Moreover, compression devices operating with piston and cylinder assemblies are relatively slow.

SUMMARY OF THE INVENTION

The object of the present invention is to provide an apparatus which is specially designed for compressing cans, especially aluminum cans, in a simple and effective manner and at a high speed. This object is achieved in that the endless belt of the device as defined in the introduction to the specification, on its outer side, has friction increasing means while the surface of the hold-down member which faces the belt is smooth and of low friction.

A device of this design will engage the supplied cans in a reliable fashion and compress them to a flat piece of metal in a time which is only a fraction of the time required for flat pressing a can by means of prior art apparatuses.

The invention will be described in greater detail hereinbelow with reference to the accompanying drawings which show an embodiment of the invention and in which:

BRIEF DESCRIPTION OF THE DRAWINGS

FIG. 1 is a vertical projection of a device according to the invention with a portion of the frame broken away to illustrate the constructional features of the invention;

FIG. 2 shows the device of FIG. 1 in a top plan view, and

FIGS. 4 and 5 show use of chains as the endless belt.

DESCRIPTION OF PREFERRED EMBODIMENTS

Figure 3:
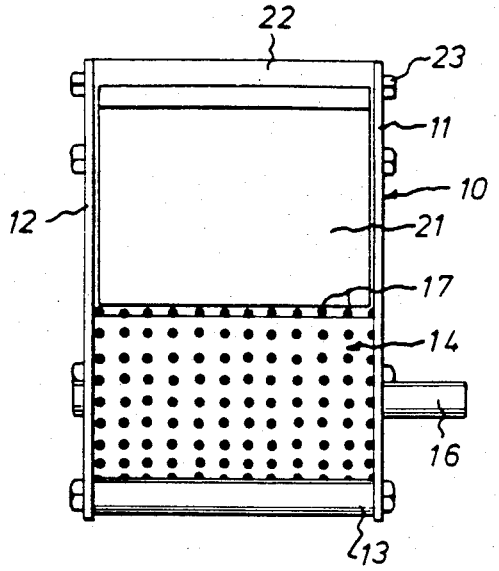
FIG. 3 shows the device from one end thereof.

The device according to the invention for compressing in particular aluminum cans comprises a frame 10 consisting of two side members 11, 12 which, as seen in FIGS. 2 and 3, are mounted in parallel spaced relation to each other by means of bars 13 extending between the side members 11, 12 and connected with these members by means of bolts. This constructional design provides a highly rigid frame structure. As seen in FIG. 1, an endless belt 14 is mounted in the frame by means of pulleys (not shown in greater detail) which are carried by journals 15, 16 mounted in the side members 11, 12 and of which the journal 16 projects from the outer face of the side member 11, as illustrated in FIGS. 2 and 3, to be connectable to a suitable drive, for instance a gear driven by an electric motor, for driving the endless belt 14. The pulley (not shown) of the belt 14 which is connected to the drive shaft 16 has suitable friction means for engaging the inner side of the belt 14 to prevent it from slipping on the pulley. According to a preferred embodiment, the belt 14 consists of a number of parallel chains, in which case the pulleys are replaced by a number of successive sprockets. On its outer side, the belt has friction increasing means 17 which may have a slightly rounded configuration, as shown in the Figures, but preferably consist of spikes or teeth for reasons which will be more apparent from the following description. A support plate 18 of a low-friction material is disposed underneath the upper run 14' of the belt 14 in FIG. 1 for supporting this belt run. The plate 18, in its turn, is supported by rods 19 extending between the two frame side members 11, 12. To impart a suitable tension to the endless belt 14, a rotary take-up pulley 20 is mounted in the side members 11, 12 and bears on the outer side of the lower belt run 14'' in FIG. 1. Preferably, the pulley 20 is adjustably perpendicularly to the longitudinal direction of the belt 14.

As seen in FIG. 1, a hold-down member in the form of a plate 21 is provided opposite the upper belt run 14'. At one end (inlet end) of the belt, the plate 21 is spaced a certain distance from the belt but approaches it progressively so as to be located close to the belt at the other end (discharge end) thereof, as is apparent from FIG. 1. The end 21' of the plate 21 at the discharge end extends beyond the belt and projects a certain distance from the frame, as shown in FIG. 1, for reasons which will be explained in the following description. The plate 21 which is rectangular in the drawings is made of a low-friction yielding material, preferably a plastic material, and most preferably a material available on the market under the trade name Robalon. The plate 21 is anchored only at the inlet end by means of a rectangular bar 22 extending between the side members 11, 12 and on the downwardly facing side of which the plate is mounted by means of countersunk screws (not shown). The bar 22 is itself connected to the side members 11, 12 by means of bolts 23 and it will be appreciated that the bar 22 can be pivoted upon release of the bolts 23 and thereafter be fixed in the set position of pivotment by tightening the bolts 23. Substantially at the centre of the longitudinal extent of the frame and, as seen in FIG. 1, slightly above the upwardly facing surface of the plate 21, there is provided a supporting rod 24 which is mounted by means of bolts and extends transversely to the belt to prevent an exaggerated displacement of the plate in a direction away from the belt run 14'. In the vicinity of the discharge end of the belt, the plate 21 bears on rubber springs 25 of the shock absorber type, which are mounted on a bar 26 extending transversely of the frame between the side members 11, 12 to which it is secured by bolts 27.

The device described above operates in the following way for compressing a can, in particular an aluminum can. The distance between the belt run 14' and the plate 21 at the inlet end of the belt is greater than the maximum diameter of the can to be subjected to compression, such that the can body can be received in the space between the belt run 14' and the plate 21. In that the belt 14 travels in the direction indicated by the arrow 28, the friction increasing means 17 on the belt run 14' will tend to pull the can further into the space between the belt run 14' and the plate 21, which can occur with but little resistance since the plate 21 has low friction and is slightly yielding at that. The plate 21 is also readily yieldable because it is anchored only at the inlet end of the belt by means of the bar 22 and thus freely bears on the rubber springs 25. Hence, the can will pass further into the space between the belt run 14' and the plate 21, and since the plate 21 cannot yield to too great an extent because of the rod 24, compression of the can will soon start at the leading end of the can, as seen in the direction of travel, such that this end of the can will be pressed rearwards and down against the circumferential surface of the can. The can is compressed to a still further extent and when compression of the trailing end of the can starts, this can end will be pressed upwards towards the circumferential surface of the can, i.e towards that side of the can which is opposed to the side against which the first-mentioned, leading can end has been pressed. As the can passes through the gap between the belt run 14' and the rubber spring 25, it is completely flattened. The tendency of the flattened can to bend in a direction away from the belt run 14' is obstructed by the end 21' of the plate 21 which extends beyond the belt and projects from the frame 10. From the discharge end of the device thus emerges a relatively planar flattened piece of metal with the former can ends pressed flat to the opposite sides of the piece of metal.

Preferably, the friction increasing means 17 are in the form of teeth or spikes which penetrate into and perforate the sheet metal of the can body, providing a satisfactory frictional engagement and also a safe indication that the can has been subjected to compression, so that nobody will ever be tempted to try and raise the compressed piece of metal to the initial shape of the can with a view to returning a deposit bottle a second time.

It has been found that with the device according to the invention, it is possible to compress an aluminum can in less than a second, and this rapid and simple compression is achieved thanks to the combination of the friction means of the endless belt and the low-friction hold-down member. The short length of the device has been made possible by the use of a yieldable hold-down member 21. A similar result can also be achieved with a rigid plate 21, this however substantially increasing the overall length of the device. The belt run 14' and the plate 21 preferably make an angle of approximately 15° with each other.

We claim:

1. A device for compressing in particular aluminum cans, comprising a frame, an endless driven belt supported in the frame to provide a belt run, and a hold-down member extending along and located opposite said belt run to define inlet and discharge ends of the belt run, wherein said belt run and said hold-down member are spaced from each other at said inlet end at a distance which exceeds the maximum diameter of the can to be compressed, and progressively approach each other to a position in which they are located close to each other at said discharge end, the hold-down member being resiliently yieldable in a direction away from the belt, at least throughout its proximal portion with respect to said discharge end, the endless belt having friction increasing means on a side facing said hold-down member, and the surface of the hold-down member which faces the belt being smooth and of low friction, the hold-down member being fixed at said inlet end, and being supported against the pressure of said compressing of said cans by spring means in the vicinity of said discharge end, and said hold-down member including a plate of elastic plastic material of low friction facing said belt run.

2. The device of claim 1, comprising at least one crossbar (24) at a distance from a side of the hold-down member which faces away from the belt, for preventing exaggerated bending of the hold-down member away from the belt.

3. The device of claim 2, comprising the hold-down member extending beyond said discharge end to prevent the compressed can from bending away from the belt run on passing through said discharge end.

4. The device of claim 3, wherein the friction increasing means of the belt comprises projections projecting from the belt surface to contact said cans.

5. The device of claim 4, wherein the belt is formed of a number of adjacent chains.

6. The device of claim 5, wherein the belt run and the hold-down member make an angle of approximately 15° with one another.

7. The device of claim 4, said projections being spikes.

8. The device of claim 6, wherein, as a result of said frame, belt and hold-down member, each said can is compressed into a flat form with a first end of the can pressed flat against a first side of the flat form and the other end of the can pressed flat against the other side of the flat form.

9. The device of claim 6, said belt run being straight.

10. The device of claim 1, comprising a bar at selected positions for pivoting said fixed inlet end of said hold-down member at a selected position for controlling the size of the opening of said inlet end.

* * * * *